US005081725A

United States Patent [19]

Neese

[11] Patent Number: 5,081,725

[45] Date of Patent: Jan. 21, 1992

[54] WATER BED PADDED RAIL ARRANGEMENT

[76] Inventor: Eric J. Neese, 7933 Marywood Dr., Newburgh, Ind. 47630

[21] Appl. No.: 301,107

[22] Filed: Jan. 25, 1989

[51] Int. Cl.[5] ..... A47C 28/08

[52] U.S. Cl. ..... 5/424; 5/508; 248/345.1

[58] Field of Search ..... 5/451, 424, 508, 427; 248/345.1

[56] References Cited

U.S. PATENT DOCUMENTS

| | | | |
|---|---|---|---|
| 3,580,469 | 5/1971 | Reese | 248/345.1 X |
| 3,869,106 | 3/1975 | Gregov | 248/345.1 |
| 4,109,887 | 8/1978 | Wakeland | 248/345.1 |
| 4,214,326 | 7/1980 | Spann | 5/424 X |
| 4,514,871 | 5/1985 | Fisher et al. | 248/345.1 X |
| 4,582,739 | 4/1986 | Givens | 248/345.1 X |
| 4,703,531 | 11/1987 | Bissett | 5/451 X |
| 4,710,992 | 12/1987 | Falwell et al. | 5/424 X |

OTHER PUBLICATIONS

Waterbed Magazine; *Padded Rails*; Dec. 1985; pp. 32–34.

Waterbed Magazine, Sunny Waterbeds & Accessories, Inc. advertisement, Mar. 1985, p. 24.

*Primary Examiner*—Gary L. Smith
*Assistant Examiner*—Michael Milano
*Attorney, Agent, or Firm*—Warren D. Flackbert

[57] ABSTRACT

A padded rail arrangement used in combination with a common water bed characterized as selectively detachable pad sections having a longitudinal cut-out undersurface adapted to be received on the upper portions of the rails defining the framework of the water bed. The invention is presented in two basic forms, to-wit, where, in one form, a pad section is adapted to continuously define a corner section of the water bed framework and, in another form, the corners of the water bed framework are exposed or uncovered. An independent mitered corner pad section utilizing the longitudinal cut-out undersurface is also presented. The pad section is typically covered by material for durability and appearance purposes.

3 Claims, 1 Drawing Sheet

WATER BED PADDED RAIL ARRANGEMENT

BACKGROUND OF THE INVENTION

As is known, usage and/or popularity of water beds is widespread, where, typically, the side rails and bottom rail defining the water bed frame are covered, both for appearance and user convenience purposes. The usual procedure utilizes manufacturing techniques kindred to upholstering, involving, by way of example, a subframe; padding; covering; stitching; tacking; and, specified corner assemblies.

BRIEF DESCRIPTION OF THE PREFERRED EMBODIMENT

The invention accomplishes the padding of a water bed frame in simple yet effective approaches, to-wit, (A) the placement of a high density foam pad sections, with an appropriate longitudinal cut-out, in an overlying relationship with the upper portions of the side rails and the bottom rail of the framework, where covering material, in turn, overlies each foam pad section; and, (B) the use of material covered cut-out foam pad sections directly overlying the upper portions of the side rails and bottom rail of the framework, but with the junctures of the side rails and the bottom rail in an uncovered or exposed condition.

In the first approach, a wedge portion is removed from a foam pad section, so that the pad section continues without interruption at a corner, i.e. a mitered effect is achieved.

In any event, a better understanding of the present invention will become more apparent from the following description, taken in conjunction with the accompanying drawing, wherein

Figure 4:
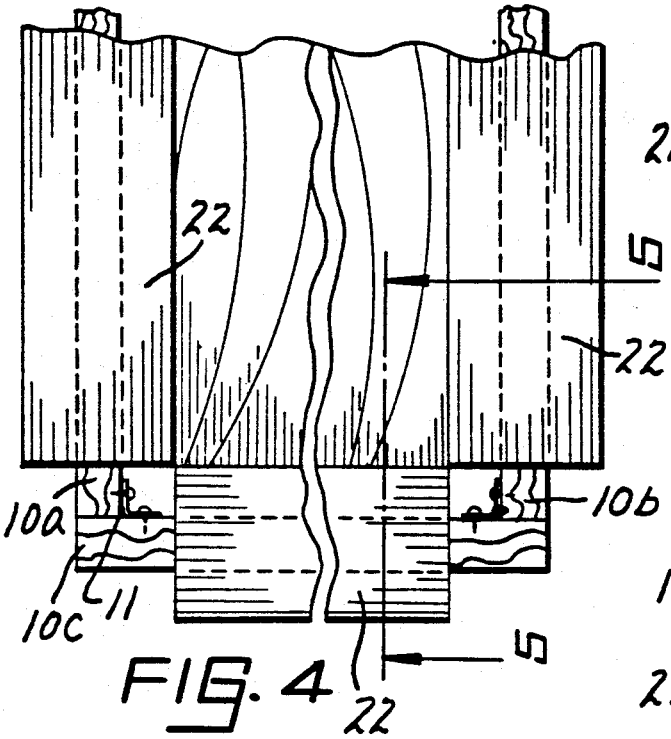
FIG. 4 is a top plan view of another form of padded rail arrangement in accordance with the teachings of the present invention; and, FIG. 5 is a view in side elevation, partly in vertical section, taken at line 5—5 on FIG. 4 and looking in the direction of the arrows, further detailin, the invention form of such figure.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 1:
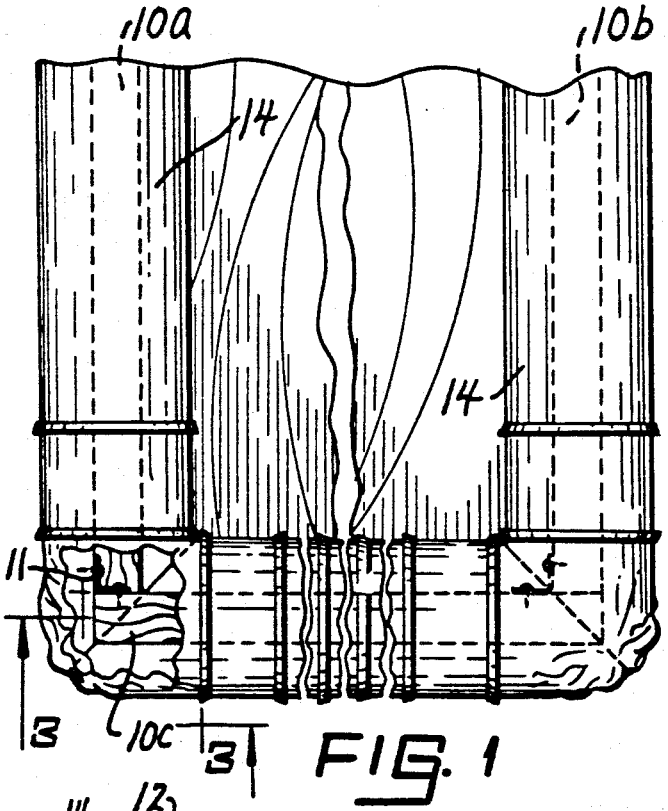
FIG. 1 is a top plan view of one form of padded rail arrangement in accordance with the teachings of present invention.
Figure 2:
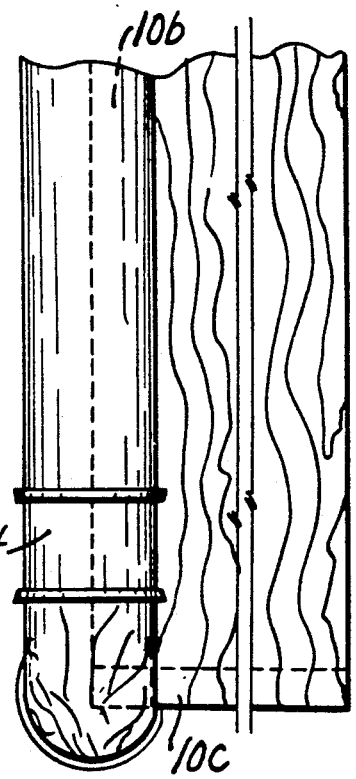
FIG. 2 is a view in side elevation, looking from right to left in FIG. 1, further detailing the invention form of such figure.
Figure 3:
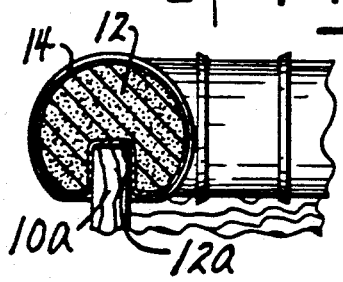
FIG. 3 is a view in vertical section, taken at line 3—3 on FIG. 1 and looking in the direction of the arrows, still further detailing the invention form of such figure.

Referring now to FIGS. 1, 2 and 3, one form of padded rail arrangement is disclosed, such being shown in combination with a framework 10 of a common water bed including side rails 10*a*–10*b* and a bottom rail 10*c* assembled, by nailed brackets 11, at rail juncture locations (see FIG. 1).

The aforesaid side rails 10*a*–10*b* and bottom rail 10*c* are each overlaid by a pad section 12, typically made from a flexible dense foam material. As evident in FIG. 3, the pad section 12 is round in vertical cross-section, but includes a longitudinal cut-out portion 12*a* along the bottom surface thereof. The latter is arranged to overlie the upper portions of both the side rails 10*a*–10*b* and the bottom rail 10*c*. In other words, positive positioning is readily accomplished by laying the pad section 12 directly on the top of the side rails 10*a*–10*b* and bottom rail 10*c*. An adhesive (not shown) may also be used to further placement.

A wedge portion (also not shown) is typically cut from a corner pad section 12 to achieve a right angle mitered type relationship (evident by the broken line in FIG. 1) and a continuous pad section 12. The then abutting faces of the cut corner pad section 12 also typically include an adhesive (again not shown) to assure positive assembly. The cornering can also be accomplished by a mitered (as in FIG. 1) independent corner pad section which overlies the juncture of the side rails 10*a*–10*b* and the bottom rail 10*c*, i.e. rests directly on the top of such along the longitudinal cut-out portion.

In any event, each pad section 12 itself is typically overlaid by a cover material 14, such as plastic, where the particular lengths of each covered pad 12 section depend on installation requirements. Some cover material stitching and/or tacking may be needed to satisfy both physical and appearance purposes.

Thus, a padded rail arrangement is disclosed which is representative of important economies both to the manufacturer and the purchaser, where such is equally true in connection with the other form of padded rail arrangement disclosed herebelow and forming part of the invention.

Figure 5:
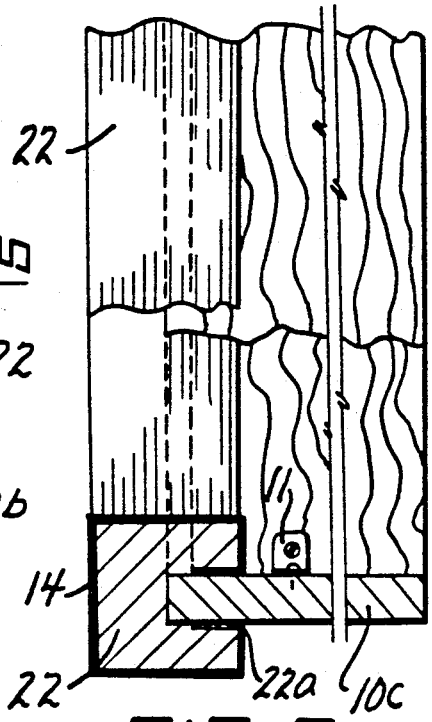

In this connection, and referring now to FIGS. 4 and 5, the arrangement of such includes no provision for corner covering, i.e. the framework 10 of the water bed is exposed at each corner area. The same principal as to each pad section 22 remains, i.e., and as a matter of example, while the pad section 22 may (alternatively) be square in vertical cross-section (see FIG. 5), such again includes the longitudinal cut-out portion 22*a* for positive assembly on the upper portions of both the side rails 10*a*–10*b* and the bottom rail 10*c*. Again, each pad section 22 includes a cover material 14, both for durability and appearance.

Moreover, and in order to further facilitate positive pad section 22 placement, a paper covered double faced adhesive tape (not shown) may be sealed onto a wall of the cut-out portion 22*a* so that, when the paper is removed, as by peeling, the pad section 22 is adhesively retained in an operative or use position.

As should be evident, the padded rail arrangements of the present invention provide a significant yet cost conscious step in solving and overcoming problems inherent with conventional padded rails for a water bed, including minimization of components, ease in placement, economies in shipping, and the like.

The arrangements described herein are susceptible to various changes within the spirit of the invention, including, by way of example, in proportioning; choice and selection of material employed; the configuration of a (assembled) pad section in vertical section; and, the like. Thus, the preceding should be considered illustrative and not as limiting the scope of the following claims:

I claim:

1. A padded rail arrangement for a water bed defined by a framework including assembled side and bottom rails comprising a selectively detachable and flexible pad section overlying a portion of each of said rails, where said pad section includes a longitudinal cut-out portion along the bottom surface thereof, where said cut-out portion is received on said portion of each of said rails, where adhesive means is disposed within said cut-out portion, and where wedge shaped portions of adjacent pad section are removed to define a corner of said framework and present a continuous padded rail.

2. The padded rail arrangement of claim 1 where the face of said pad section exposed after said wedge shaped portions are removed is in an abutting relationship with an adjacent face.

3. The padded rail arrangement of claim 2 where adhesive means secure said abutting faces in an assembled condition.

* * * * *